US010263323B2

(12) United States Patent
Girard et al.

(10) Patent No.: US 10,263,323 B2
(45) Date of Patent: Apr. 16, 2019

(54) ANTENNA STRUCTURE WITH SELF SUPPORTING FEATURE

(71) Applicant: THOMSON LICENSING, Issy de Moulineaux (FR)

(72) Inventors: Henri Girard, Carmel, IN (US); Joseph Lee Carpenter, Noblesville, IN (US)

(73) Assignee: INTERDIGITAL CE PATENT HOLDINGS, Paris (FR)

( * ) Notice: Subject to any disclaimer, the term of this patent is extended or adjusted under 35 U.S.C. 154(b) by 117 days.

(21) Appl. No.: 15/312,763

(22) PCT Filed: May 28, 2015

(86) PCT No.: PCT/US2015/032810

§ 371 (c)(1),
(2) Date: Nov. 21, 2016

(87) PCT Pub. No.: WO2015/184052

PCT Pub. Date: Dec. 3, 2015

(65) Prior Publication Data

US 2017/0194702 A1 Jul. 6, 2017

Related U.S. Application Data

(60) Provisional application No. 62/004,934, filed on May 30, 2014.

(51) Int. Cl.
*H01Q 1/38* (2006.01)
*H01Q 9/42* (2006.01)
(Continued)

(52) U.S. Cl.
CPC ..... *H01Q 1/38* (2013.01); *H01Q 1/48* (2013.01); *H01Q 9/0414* (2013.01); *H01Q 9/42* (2013.01)

(58) Field of Classification Search
CPC ..... H01Q 1/38; H01Q 1/48; H01Q 9/0414
See application file for complete search history.

(56) References Cited

U.S. PATENT DOCUMENTS 6,744,409 B2 6/2004 Ellis et al.
2003/0201943 A1 10/2003 Kadambi et al.
(Continued)

FOREIGN PATENT DOCUMENTS

CA 2644946 11/2007
EP 1569298 8/2006
WO WO2007126897 11/2007

OTHER PUBLICATIONS

Hong et al.: Design of an internal monopole Antenna for GSM900/DCS1800/US-PCS/S-DMB. IEEE Transactions on Antennas and Propagation, vol. 56, No. 5, May 2008.
(Continued)

*Primary Examiner* — Dameon E Levi
*Assistant Examiner* — David E Lotter
(74) *Attorney, Agent, or Firm* — Tutunjian & Bitetto, P.C.

(57) ABSTRACT

An antenna including a first conductive element having a first length and including a first connecting interface to connect, at a first end, the antenna structure to an electrical circuit, a second conductive element having a second length, the second conductive element connecting, at a first end, to a second end of the first conductive element, and a third conductive element having a third length and connecting at a first end to a second end of the second conductive element and oriented at an angle that is orthogonal to the orientation axis for the first conductive element and the second conductive element. The antenna can be placed by machine without the antenna moving or tilting in any direction prior attaching to a printed circuit board.

37 Claims, 3 Drawing Sheets

(51) Int. Cl.
*H01Q 1/48* (2006.01)
*H01Q 9/04* (2006.01)

(56) References Cited

U.S. PATENT DOCUMENTS

2004/0075611 A1* 4/2004 Kenoun ..... H01Q 1/243
343/702
2007/0008221 A1* 1/2007 Tseng ..... H01Q 1/2216
343/700 MS
2013/0265201 A1* 10/2013 Kanj ..... H01Q 1/243
343/700 MS

OTHER PUBLICATIONS

Thaysen et el.: Capacitive Loading shrinks mobile PIFAs, Part 1. Technical University of Denmark, Publication Date 2007, 9 pages.
Thaysen et al.: Capacitive Loading shrinks mobile PIFAs, Part 2, Technical University of Denmark, Publication date 2007, 5 pages.

* cited by examiner

ANTENNA STRUCTURE WITH SELF SUPPORTING FEATURE

CROSS REFERENCE TO RELATED APPLICATION

This application claims the benefit, under 35 U.S.C. § 365 of International Application PCT/US2015/032810, filed May 28, 2015, which was published in accordance with PCT Article 21(2) on Dec. 3, 2015 in English and which claims the benefit of U.S. Provisional application No. 62/004,934, filed May 30, 2014, which is incorporated by reference herein in its entirety.

TECHNICAL FIELD OF THE INVENTION

The present disclosure generally relates to an antenna structure. More specifically, the present disclosure relates to a unitary antenna structure that includes a self supporting feature for mounting on a printed circuit board.

BACKGROUND OF THE INVENTION

This section is intended to introduce the reader to various aspects of art, which may be related to the present embodiments that are described below. This discussion is believed to be helpful in providing the reader with background information to facilitate a better understanding of the various aspects of the present disclosure. Accordingly, it should be understood that these statements are to be read in this light.

Wireless communication networks are present in many communication systems today. Many of the communication devices used in the systems include one or more antennas for interfacing to the network. These communication devices often include, but are not limited to, set-top boxes, gateways, cellular or wireless telephones, televisions, home computers, media content players, and the like. Further, many of these communication devices may include multiple interfaces for different types of networks. As a result, one or more antennas may be present on or in a communication device.

The antennas used in communication devices may be designed to be mounted directly to a printed circuit board. FIG. 1 illustrates an exemplary antenna designed to be mounted on a printed circuit board located inside a communication device. The exemplary antenna is referred to as an inverted f antenna. FIG. 1 includes a conductive element 110. Element 110 operates with similar characteristics to a monopole antenna over a ground plane. One end of element 120 connects to element 110 at a point that is a predetermined distance from one end of element 110. The other end of element 120 is the interface point to an electrical circuit, such as a communication circuit. The length of element 110 is selected to be approximately one quarter wavelength of the operating frequency of the antenna. The distance from the end of element 110 to the connection point with element 120 is chosen such that the radiation resistance is as close as possible to the operating impedance or resistance for the communication circuit connected to element 120.

The end of element 110 closest to element 120 is connected to one end of another conductive element 130. The other end of element 130 is an interface for connecting to ground. The addition of element 130 is important to the structure of an inverted f antenna. Since the antenna length is usually selected to be less than a full wavelength of the operating frequency for the antenna, the electrical interface for the antenna may electrically operate equivalent to a resistive element in series with a low value capacitive element. Element 130 electrically operates similar to adding an inductor in parallel with the remaining equivalent elements in the antenna. As a result, element 130 reduces the effect of the equivalent series capacitance for the antenna. Finally, the other end of element 110 connects to one end of conductive element 140. Element 140 primarily acts as a support or counter balance to prevent unintentional dislodging from its mounting holes in the printed circuit board during the manufacturing process for the device. The other end of element 140 does not typically connect electrically to a circuit.

Problems often exist with antenna structures that are mounted to a printed circuit board. For instance, the antenna may move or shift from its original mounted position during the manufacturing process. Moving or shifting is particularly problematic with antennas that do not have a balanced center of mass. Although the antenna shown in FIG. 1 adds element 140 to prevent movement or tipping in one direction, the antenna does not sufficiently restrict movement to prevent tilt or shift in other directions. For instance, the antenna may tilt sideways relative to a vertical plane prior to completion of assembly or soldering and remain locked in this tilted position after completion. The shifting or tilt of the antenna structure may cause performance issues due to improper antenna orientation or further due to improper position with respect to other components or circuits. Therefore, there is a need for an improved antenna structure that includes a self supporting feature to address these and other issues.

SUMMARY

The above presents a simplified summary of the subject matter in order to provide a basic understanding of some aspects of subject matter embodiments. This summary is not an extensive overview of the subject matter. It is not intended to identify key/critical elements of the embodiments or to delineate the scope of the subject matter. Its sole purpose is to present some concepts of the subject matter in a simplified form as a prelude to the more detailed description that is presented later.

According to an aspect of the present disclosure, an antenna structure is described. The antenna structure includes a first conductive element having a first length, the first conductive element including a first connecting interface to connect, at a first end, the antenna structure to an electrical circuit, a second conductive element having a second length, the second conductive element connecting, at a first end, to a second end of the first conductive element, and a third conductive element having a third length, the third conductive element connecting, at a first end, to a second end of the second conductive element and oriented at an angle that is orthogonal to the orientation axis for the first conductive element and the second conductive element.

According to another aspect of the present disclosure, a communication apparatus is described. The communication apparatus includes a circuit capable of at least one of wirelessly transmitting and receiving a signal, and an antenna coupled to the circuit. The antenna further includes a first conductive element having a first length, the first conductive element including a first connecting interface to connect, at a first end, the antenna structure to an electrical circuit, a second conductive element having a second length, the second conductive element connecting, at a first end, to a second end of the first conductive element, and a third conductive element having a third length, the third conductive element connecting, at a first end, to a second end of the second conductive element and oriented at an angle that is orthogonal to the orientation axis for the first conductive element and the second conductive element.

According to a further aspect of the present disclosure, a method is described. The method includes forming a first conductive element of an antenna structure, the first conductive element having a first length, the first conductive element including a first connecting interface to connect, at a first end, the antenna structure to an electrical circuit, forming (620) a second conductive element of the antenna structure, the second conductive element having a second length and further connecting, at a first end, to a second end of the first conductive element, and forming (630) a third conductive element of the antenna structure, the third conductive element having a third length and further connecting, at a first end, to a second end of the second conductive element and oriented at an angle that is orthogonal to the orientation axis for the first conductive element and the second conductive element.

BRIEF DESCRIPTION OF THE DRAWINGS

These, and other aspects, features and advantages of the present disclosure will be described or become apparent from the following detailed description of the preferred embodiments, which is to be read in connection with the accompanying drawings.

Figure 1:
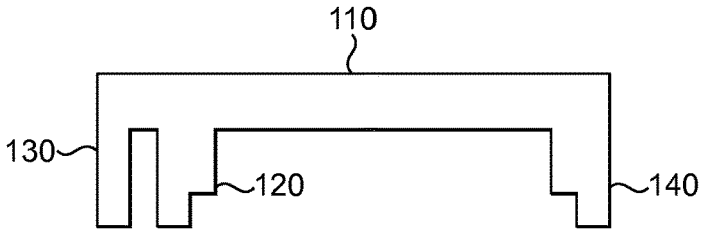
FIG. 1 (PRIOR ART)
FIG. 1 is a diagram of an exemplary inverted f antenna.

It should be understood that the drawing(s) are for purposes of illustrating the concepts of the disclosure and is not necessarily the only possible configuration for illustrating the disclosure, as known by those skilled in the art.

DETAILED DESCRIPTION OF PREFERRED EMBODIMENTS

It should be understood that some of the elements shown in the figures may be implemented in various forms of hardware, software or combinations thereof. Preferably, these elements are implemented in a combination of hardware and software on one or more appropriately programmed general-purpose devices, which may include a processor, memory and input/output interfaces. Herein, the phrase "coupled" is defined to mean directly connected to or indirectly connected with through one or more intermediate components. Such intermediate components may include both hardware and software based components.

The present description illustrates the principles of the present disclosure. It will thus be appreciated that those skilled in the art will be able to devise various arrangements that, although not explicitly described or shown herein, embody the principles of the disclosure and are included within its scope.

All examples and conditional language recited herein are intended for educational purposes to aid the reader in understanding the principles of the disclosure and the concepts contributed by the inventor to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure. For example, it will be appreciated by those skilled in the art that the diagrams presented herein represent conceptual views of illustrative circuitry and elements embodying the principles of the disclosure The functions of the various elements shown in the figures may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, read only memory (ROM) for storing software, random access memory (RAM), and nonvolatile storage.

The present disclosure is directed at the problems related to mounting an antenna on a printed circuit board used as part of a communication circuit. The antenna may shift or move during the manufacturing process. The shifting or movement may result in improper orientation or placement relative to the other components associated with the communication circuit. The present disclosure attempts to at least address these issues.

The embodiments of the present disclosure are related to an antenna structure that may be mounted on to a printed circuit board. The disclosure describes an improvement to an inverted f antenna design. The improvement includes an additional portion oriented orthogonal to both the long element or segment of the antenna and to the planar axis of the antenna. The top bend improves the manufacturing process by allowing the antenna to be used with pick and place machines for assembly.

The end of the additional portion at the open end of the antenna includes a bend that is further orthogonal to both the additional portion and the planar axis of the antenna. The bend does not physically connect to an electrical circuit but acts as a third leg that is orthogonal to the other antenna support elements and balances or supports the antenna. The bend also facilitates capacitive loading for the antenna by positioning the bend near a conductive ground plane on the printed circuit board. The capacitive loading lowers the resonant frequency for the antenna based on the physical dimensions of the antenna. As a result, a smaller antenna structure may be used at the desired operating frequency for the antenna.

Additional bends in the first and second legs of the inverted f antenna may also provide additional structural support. The bends may be used in conjunction with the first and second legs being configured for surface mounting and soldering to the printed circuit board. The additional support mechanisms allow the antenna it to be placed by machine without the issue of the antenna moving or tilting any direction and soldered to the printed circuit board.

Described herein are mechanisms for implementing one or more antennas in a communication device. In particular, the mechanisms are described with respect to an inverted f antenna. It is important to note that the mechanisms may be adapted for use in other antenna designs, particularly those that may traditionally be designed to operate at frequencies associated with air dielectric interface designs and may have an unbalanced center of mass. The mechanisms are further useful with antenna designs at frequencies below the frequency range for which microstrip or patch antennas may be practical. For instance, with only minor modifications, the embodiments described below could be modified to work with a dipole antenna included in or with a communication device.

Figure 2:
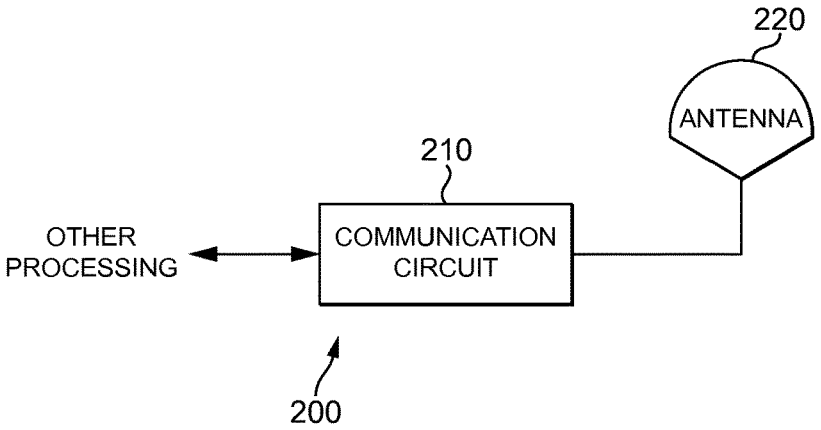
FIG. 2 is a block diagram of an exemplary communication device in accordance with aspects of the present disclosure.

Turning now to FIG. 2, a block diagram of an embodiment of a communication device 200 according to aspects of the present disclosure is shown. Communication device 200 may be used as part of a communication receiver, transmitter, and/or transceiver device including, but not limited to, a handheld radio, a set-top box, a gateway, a modem, a cellular or wireless telephone, a television, a home computer, a tablet, and a media content player. Communication device 200 may include one or more interfaces to wireless networks including, but not limited to, Wi-Fi, Institute of Electrical and Electronics Engineers (IEEE) standard 802.11 or other similar wireless communication protocols. It is important to note that several components and interconnections necessary for complete operation of communication device 200, either as a standalone device, or incorporated as part of another device, are not shown in the interest of conciseness, as the components not shown are well known to those skilled in the art.

Communication device 200 includes a communication circuit 210 that interfaces with other processing circuits, such as a content source and/or a content playback device, not shown. Communication circuit 210 connects to antenna 220. Antenna 220 provides the interface to the airwaves for transmission and reception of signals to and from communication device 200.

Communication circuit 210 includes circuitry for improving transmission and reception of a signal interfaced through antenna 220 to another device over a wireless network. A received signal from antenna 220 may be amplified by a low noise amplifier and tuned by a set of filters, mixers, and oscillators. The tuned signal may be digitized and further demodulated and decoded. The decoded signal may be provided to other processing circuits. Additionally, communication circuit 210 generates, converts, and/or formats an input signal (e.g., an audio, video, or data signal) from the other processing circuits for transmission through antenna 220. Communication circuit 210 may include a power amplifier for increasing the transmitted signal level of the signal sent from communication device 200 over the wireless network. Adjustment of the amplification applied to a signal received from antenna 220 as well as amplification for a signal transmitted by antenna 220 may be controlled by a circuit in communication circuit 210 or may be controlled by other processing circuits.

Communication circuit 210 also includes interfaces to send and receive data (e.g., audio and/or video signals) to other processing circuits (not shown). Communication circuit 200 further amplifies and processes the data in order to either provide the data to antenna 220 for transmission or to provide the data to the other processing circuits. Communication circuit 210 may receive or send audio, video, and/or data signals, either in an analog or digital signal format. In one embodiment, communication circuit 210 has an Ethernet interface for communicating data to other processing circuits and an orthogonal frequency division multiplexing (OFDM) interface for communicating with antenna 220. Communication circuit 210 includes processing circuits for converting signals between Ethernet format and OFDM format.

Antenna 220 interfaces signals between communication circuit 210 and the wireless network. In a preferred embodiment, antenna 220 is an inverted f antenna and is further designed to be mounted on a printed circuit board, such as the printed circuit board used for communication circuit 210. The antenna 220 includes conductive elements that form a structure that supports the antenna such that the antenna remains in its proper orientation during the manufacturing process for communication device 200. Further details regarding the design of an antenna, such as antenna 220, will be described below.

It is important to note that more than one antenna 220 may be used in communication device 200. The use of more than one antenna provides additional performance capability and control options. For example, in one embodiment, a first antenna may be oriented in a first orientation or axis with a second antenna oriented in a second orientation or axis. In another embodiment, two antennas may be spaced physically at opposite ends of communication device 200 or a larger device that includes communication device 200. The use of multiple antennas in embodiments as described herein permit such performance improvements as orientation control, diversity transmission or reception, antenna steering, and multiple input multiple output signal transmission and reception.

Communication device 200 in FIG. 2 is described primarily as operating with a local wireless network, such as WiFi or IEEE 802.11. It should be appreciated by one skilled in the art that other network standards that incorporate a wireless physical interface may be used. For instance, communication device 200 may easily be used with a Bluetooth network, a WiMax network, or any number of cellular phone network protocols. Further, more than two networks may be used either alternatively or simultaneously together.

Figure 3:
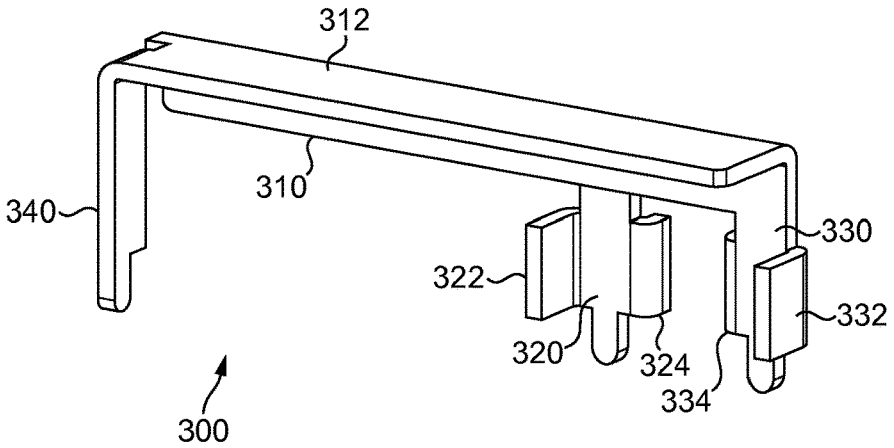
FIG. 3 is a perspective view of an exemplary antenna in accordance with aspects the present disclosure.

Turning now to FIG. 3, an illustration of a perspective view of an exemplary antenna 300 using aspects of the present disclosure is shown. Antenna 300 may be used as part of a communication device, such as communication device 200 described in FIG. 2. Further, antenna 300 may be included a larger multifunctional device, such as, but not limited to a handheld radio, a set-top box, a gateway, a modem, a cellular or wireless telephone, a televisions, a home computer, a tablet, and a media content player.

Antenna 300 includes conductive element 310 coupled to one end of conductive element 330. The other end of element 330 provides an electrical interface to ground. One end of conductive element 320 is coupled to element 310 at a point close to the end of element 310 that is connected to element 330. The other end of element 320 provides the electrical interface for a communication circuit (e.g., communication circuit 210 described in FIG. 2). Element 320 may connect to an electrical element, such as an inductor, capacitor, or resistor, in the communication circuit. Element 310 also includes a section 312 that is orthogonal to the main section of element 310. Section 312 may span the entire length of element 310. One end of section 312, or alternatively, the end of element 310, is connected to one end of element 340. Element 340 is orthogonal to both section 312 and the main section of element 310. Element 340 is also orthogonal to elements 320 and 330. The other end of element 340 does not connect electrically to communication circuit but may be capacitively coupled to ground. Element 320 further includes tabs 322 and 324 which are located on each side of element 320 and are orthogonal to element 320 and oriented in opposite directions from each other. Element 330 also includes tabs 332 and 334 which are located on each side of element 330 and are orthogonal to element 330.

The elements in antenna 300 may use any conductive material. In one embodiment, the elements comprise copper or a copper alloy. In other embodiments, other materials possessing different conductivities may be used, including, but not limited to, gold, silver, platinum or any combination of material alloys.

Antenna 300 describes an exemplary inverted f antenna for mounting to a printed circuit inside a communication device. Unlike previous antennas, such as the antenna described in FIG. 1, antenna 300 includes support mechanisms that are orthogonal to the main elements of the antenna. In a first support structure, element 340 provides orthogonal support to the one end of element 310 preventing antenna 300 from tipping or tilting when mounted on a printed circuit board. The orthogonal support is created by orienting section 312 of element 310 to be orthogonal to the planar axis of antenna 300. For example, if the planar axis of antenna 300 is the y-axis, then portion 312 is planar along the x-axis. Element 340 is extended from section 312 and is further orthogonal to both the planar axis of antenna 300 and the section 312. As a result, element 340 is oriented to be planar along the z-axis. It is important to note that element 340 may be extended from element 310.

The section 312 included with element 310 facilitates use of antenna 300 in high volume manufacturing processes. Section 312 is horizontally oriented when antenna 300 is placed onto a printed circuit board. The surface of section 312 may be used in conjunction with component pick and place machines for automatic placement on the printed circuit board. Further, section 312 provides additional material to element 310. The additional material and the orthogonal orientation of section 312 improves the electrical characteristics, and in particular the operating frequency bandwidth and return loss, of antenna 300.

Element 340 may also be used to produce an antenna that may be reduced in size for a given frequency of operation. Antennas such as antenna 300 rely on characteristics associated with elements and materials around the antenna in order to determine the relationship between antenna physical parameters and antenna electrical operation parameters. Physical parameters, including the size, thickness, and length of the elements, along with conductivities and dielectric constants for materials used with the antenna, determine the electrical operating frequency for the antenna. The length for element 310 is typically equal to one quarter wavelength of the frequency of operation. A shorter length may be used by introducing additional capacitive coupling at the open of the element 310. Element 340 may be used to introduce the additional capacitive coupling to a conductive ground. Further details related to the capacitive coupling mechanism will be described below.

A second support structure may also be formed using elements 320 and 330. Element 320 includes tabs 322 and 324 and element 330 includes tabs 332 and 334. The orientation of tabs 322, 324, 332, and 334 provide a support surface for antenna 300 when placed onto the printed circuit board. Elements 320 and 330 may extend through the printed circuit board and soldered to a conductive surface on the bottom of the printed circuit board using a liquid wave soldering process. Alternatively, elements 320 and 330 may include details to allow antenna 300 to be surface mounted to the top surface of the printed circuit and soldered using a paste reflow soldering process.

Figure 4:
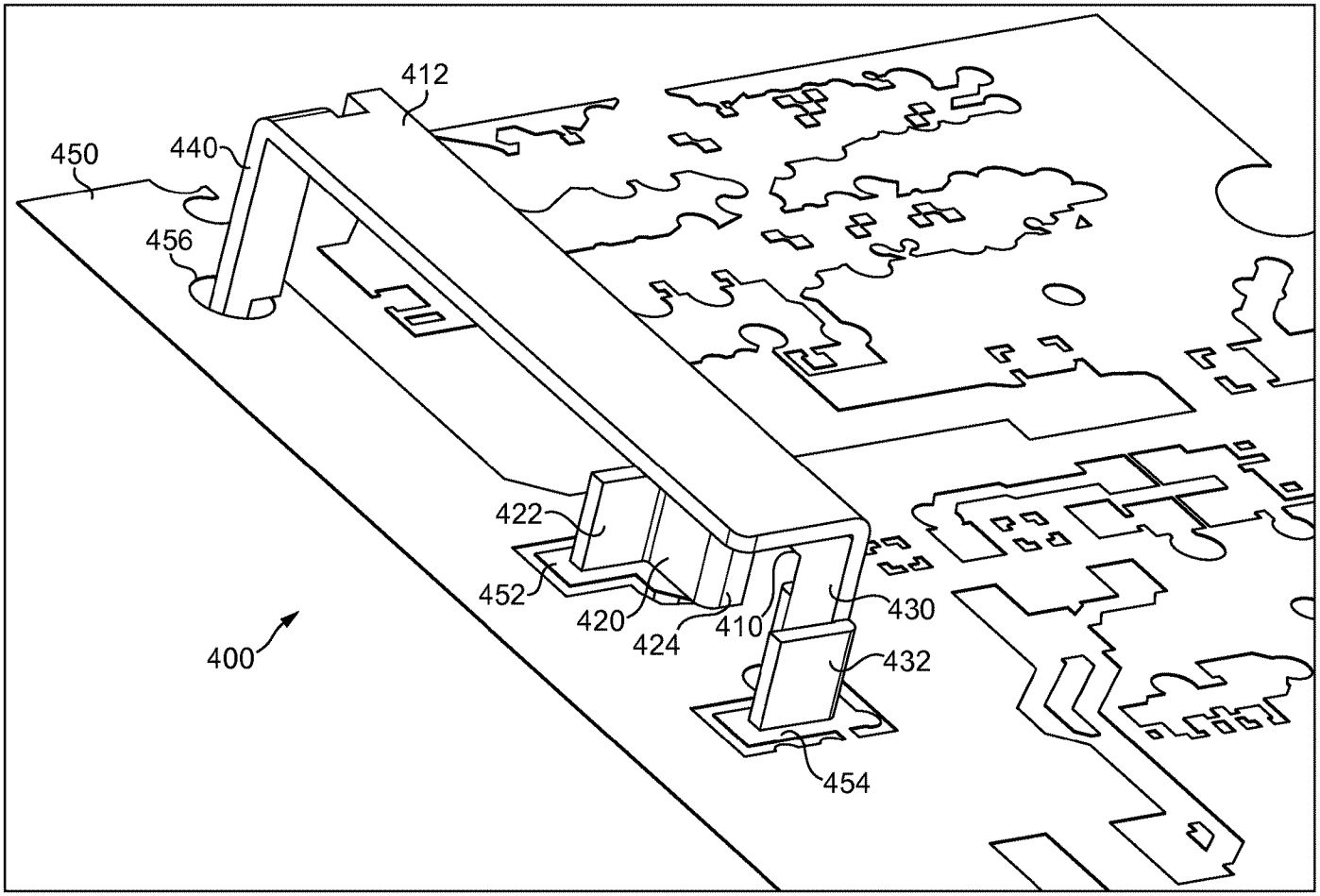
FIG. 4 is a diagram of a printed circuit board structure including the exemplary antenna in accordance with aspects of the present disclosure.

Turning now to FIG. 4, a diagram of a printed circuit board structure 400 including an exemplary antenna in accordance with aspects of the present disclosure is shown. In particular, circuit board structure 400 will be described in relation to mounting arrangement for antenna 300 described in FIG. 3. The construction and manufacturing processes for printed circuit boards and component placement will not be described in detail here as they are well known by those skilled in the art.

Circuit board structure 400 includes elements 410-440 positioned in a manner similar to that described earlier for antenna 300 in FIG. 3. Circuit board structure 400 also includes a top surface pattern 450. Top surface pattern 450 represents a conductive pattern and mounting layout for components such as the antenna. Element 452 shows the copper pattern and slot opening for the end of element 420. Element portions 422 and 424 do not pass through but instead rest on the circuit board structure 400. The top surface pattern 450 shows conductive material that may include one or conductive traces that electrically connect element 420 to a circuit (e.g., communication circuit 210 described in FIG. 2). In an alternate embodiment, element 420 may be configured for surface mounting to the top surface pattern 450.

Element 452 and element 454 show the copper pattern and slot opening for the ends of element 420 and element 430. Element 432 does not pass through but instead rests on the circuit board structure 400. The top surface pattern 450 shows conductive material that may include one or more conductive traces that electrically connect element 430 to ground. In an alternate embodiment, element 420 and/or element 430 may be configured for surface mounting to the top surface pattern 450 by eliminating slot openings in element 452 and/or element 454.

Element 456 includes an opening but no conductive pattern connected to the end of element 440. In one embodiment, Element 440 may include a portion that extends into or through an opening in circuit board structure 400. In another embodiment, element 440 may rest on the opening at element 456. In yet another embodiment, element 440 may rest on top surface pattern 450 at element 456 with no opening and also devoid of a conductive pattern.

In still another embodiment, element 456 may include a conductive pattern connected to the end of element 440. The conductive pattern may be used to connect an electrical component between the end of element 440 and the ground connection on circuit board structure 400. The electrical component may include one or more of a capacitor, a resistor, and an inductor may be used to further tune the operating frequency for the antenna structure.

As described earlier, antenna 400 may be tuned to a desired frequency of operation, given the nominal physical length used for elements 410 and 440, by using the conductive pattern on top surface pattern 450 in proximity to the end of element 440. The amount of capacitance may be adjusted by adding conductive material to top surface pattern 450, changing the distance of the conductive material to element 440, and/or adjusting the dimensions of the opening used in element 456.

Figure 5:
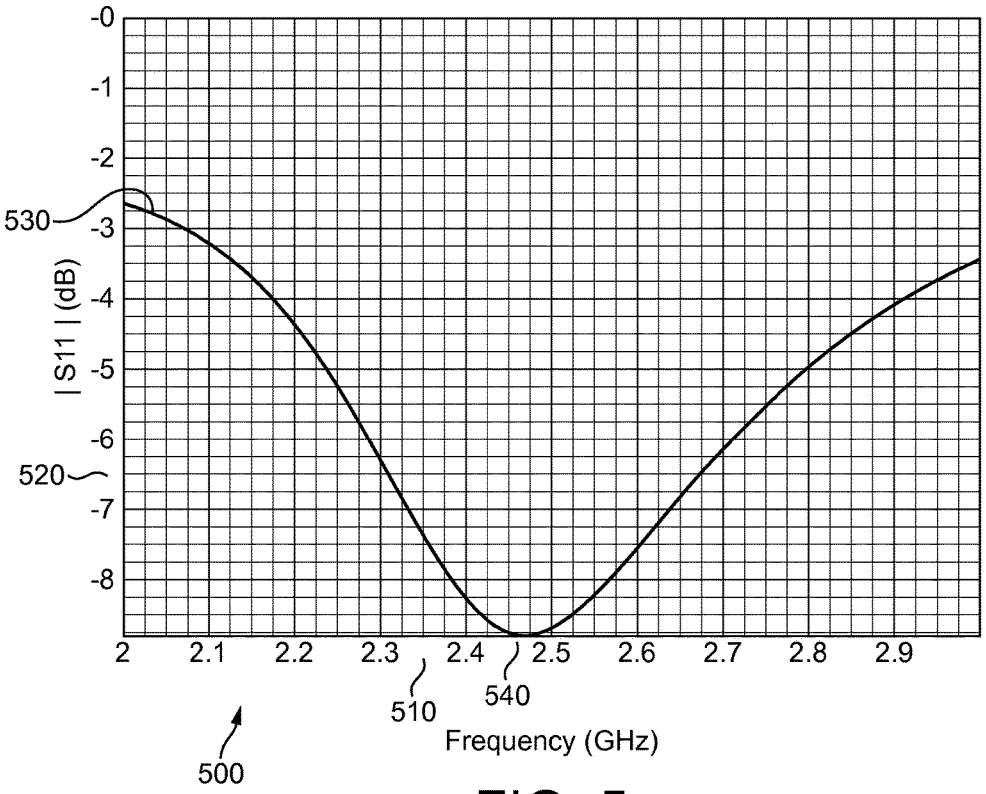
FIG. 5 is a graph illustrating a characteristic of an exemplary antenna in accordance with aspects of the present disclosure.

FIG. 5 illustrates a graph 500 of an electrical characteristic of antenna 300 in accordance with aspects of the present disclosure. Graph 500 represents the scalar value for return loss of antenna 300 versus frequency as measured at the antenna electrical terminal (e.g., element 320). Graph 500 includes an x-axis 510 displaying frequency in GHz. Graph 500 also includes a y-axis 520 displaying return loss, displayed as (S11), in decibels (dB). Line 530 displays the value of return loss versus frequency for antenna 300. Point 540 displays the minimum value for return loss, representing the best impedance match point between antenna 300 and the expected circuit impedance at element 320.

Figure 6:
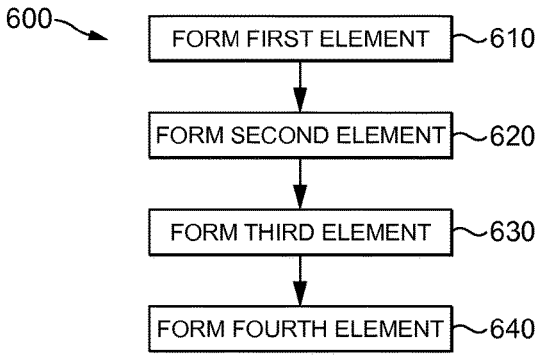
FIG. 6 is a flow chart of an exemplary process for manufacturing an antenna in accordance with aspects of the present disclosure.

Turning now to FIG. 6, a flow chart of an exemplary process 600 for manufacturing an antenna in accordance with aspects of the present disclosure is shown. Process 600 may be incorporated as part of a process for manufacturing an antenna, such as antenna 300 described earlier in FIG. 3 or antenna 400 described earlier in FIG. 4. Process 600 may also be incorporated as part of a process for manufacturing a communication device, such as communication device 200 described in FIG. 2. Process 600 may also rely on certain manufacturing techniques and materials including but not limited to the techniques and materials described in FIG. 4. Specific details regarding certain manufacturing techniques needed for manufacturing antennas and/or devices will not be further described here as they are well known to those skilled in the art.

Process 600 forms an antenna, as part of the manufacturing process, using one or more conductive elements. The one or more conductive elements are formed and/or connected together using one or more common conductive materials (e.g., copper, silver, gold and the like) to include features that self-support the antenna in a manner that improves high volume manufacturing for placing the antenna into a product. For example, the antenna may be placed by machine without the antenna moving or tilting in any direction prior to attaching to the printed circuit board. In one embodiment, the antenna formed by process 600 is an inverted F antenna intended to operate at a frequency of 2.5 GHz or lower.

At step 610, a first element or portion of an antenna structure is formed. The first element includes a first length and has a first connecting interface to connect the antenna structure to an electrical circuit (e.g., a circuit in receiver 200) at a first end of the first conductive element. At step 620, a second element or portion of the antenna structure is formed. The second element has a second length that may be different from the first length, and further connects, at a first end, to a second end of the first element.

At step 630, a third element or portion of the antenna structure is formed. The third element has a third length that may be different from the second length but may be similar to the first length. The third element may be parallel but not coplanar with the first conductive element. The third element further connects, at a first end, to a second end of the second conductive element and is oriented at an angle that is orthogonal to the orientation axis for the first conductive element and the second conductive element. It is important to note that the first element may be formed, at step 610, to include a first portion that is at an angle that is orthogonal to the orientation axis for the first conductive element and the second conductive element and parallel, but not coplanar, to the third conductive element.

In one embodiment, the third element and the first section of the first element are formed to support the antenna structure when it is placed on a printed circuit board. Further, the second element includes a first section that extends from an upper edge of the second element and is parallel to the printed circuit board when the antenna structure is mounted to the printed circuit board.

In some embodiments, process 600 may be continued in order to form an additional structural and operational element of the antenna structure. At step 740, a fourth element or portion of the antenna structure is formed. The fourth element has a length similar to the first length and further connects, at a first end, to the second element at a point on the second element between the first element and the third element. The fourth element also connects, at a second end, to the electrical circuit, with the fourth element being in parallel and coplanar with the first element. In one embodiment, similar to an embodiment described earlier, the fourth element may be formed to include a first portion that is at an angle that is orthogonal to the orientation axis for the first element and the conductive element and parallel, but not coplanar, to the third element.

The embodiments of the present disclosure are related to an antenna structure that may be mounted on to a printed circuit board. The embodiments describe modifications to an inverted f antenna design. The modifications include features to self-support the antenna and are intended to improve high volume manufacturing. The modifications include an additional section oriented orthogonal to the long element or segment of the antenna and to the planar axis of the antenna that allows the antenna to be used with pick and place machines for assembly. The end of the additional section at the open end of the antenna includes a bend that is further orthogonal to both the additional section and the planar axis of the antenna. The antenna design is intentionally set to an operating frequency that is higher than the desired operating frequency. The resonant frequency is adjusted to the desired frequency by top loading with capacitance that is created by placing the bend in proximity to a ground plane on a printed circuit board. The bend also acts as a third leg that is orthogonal to the other antenna support elements and balances or supports the antenna. Additional bends in the first and second legs of the antenna may also provide additional structural support. The bends may be used in conjunction with the first and second legs being configured for surface mounting and soldering to the printed circuit board. The additional support mechanisms allow the antenna it to be placed by machine without the issue of the antenna moving or tilting any direction prior to the antenna being soldered to the printed circuit board.

Although embodiments which incorporate the teachings of the present disclosure have been shown and described in detail herein, those skilled in the art can readily devise many other varied embodiments that still incorporate these teachings. Having described preferred embodiments of an antenna with self supporting feature (which are intended to be illustrative and not limiting), it is noted that modifications and variations can be made by persons skilled in the art in light of the above teachings. It is therefore to be understood that changes may be made in the embodiments of the disclosure disclosed which are within the scope of the disclosure as outlined by the appended claims.

What is claimed is:

1. An antenna structure comprising:

a first conductive element having a first length, the first conductive element including a first connecting interface to connect, at a first end, the antenna structure to an electrical circuit;

a second conductive element having a second length, the second conductive element connecting, at a first end, to a second end of the first conductive element;

a third conductive element having a third length, the third conductive element connecting, at a first end, to a second end of the second conductive element and orthogonal to the first conductive element and the second conductive element; and a fourth conductive element having the first length, the fourth conductive element connected, at a first end to the second conductive element at a point on the second conductive element between the first conductive element and the third conductive element, the fourth conductive element connected, at a second end, to the electrical circuit, the fourth conductive element being in parallel and coplanar with the first conductive element.

2. The antenna structure of claim 1, wherein the third conductive element is parallel but not coplanar with the first conductive element.

3. The antenna structure of claim 1, wherein the first conductive element includes a first portion that is orthogonal to the first conductive element and the second conductive element and parallel to the third conductive element.

4. The antenna structure of claim 3, wherein the third conductive element and the first section of the first conductive element support the antenna structure on a printed circuit board.

5. The antenna structure of claim 4, wherein the second conductive element includes a first section that extends from an upper edge of the second conductive element and is parallel to the printed circuit board when the antenna structure is mounted to the printed circuit board.

6. The antenna structure of claim 5, wherein the antenna structure can be placed by machine without the antenna structure moving or tilting in any direction prior to attaching to the printed circuit board.

7. The antenna structure of claim 4, wherein the third conductive element and the first conductive element rest on a surface of the printed circuit board.

8. The antenna structure of claim 1 wherein the third conductive element is capacitively coupled to the ground of the electrical circuit.

9. The antenna structure of claim 1, wherein the fourth conductive element includes a first portion orthogonal to the first conductive element and the second conductive element and parallel to the third conductive element.

10. The antenna structure of claim 1, wherein the fourth conductive element connects to an electrical element in the electrical circuit and the first conductive element connects to the ground of the electrical circuit.

11. The antenna structure of claim 1, wherein the antenna structure forms an inverted f antenna.

12. The antenna structure of claim 1, wherein the antenna structure is used at an electrical frequency that is less than or equal to 2.5gigahertz.

13. A communication apparatus comprising:

a circuit capable of at least one of wirelessly transmitting and receiving a signal; and an antenna coupled to the circuit, the antenna including:

a first conductive element having a first length and including a first connecting interface to connect, at a first end, the antenna structure to an electrical circuit;

a second conductive element having a second length, the second conductive element connecting, at a first end, to a second end of the first conductive element;

a third conductive element having a third length, the third conductive element connecting, at a first end, to a second end of the second conductive element and orthogonal to first conductive element and the second conductive element; and a fourth conductive element having the first length, the fourth conductive element connected, at a first end, to the second conductive element at a point on the second conductive element between the first conductive element and the third conductive element, the fourth conductive element connected, at a second end, to the electrical circuit, the fourth conductive element being in parallel and coplanar with the first conductive element.

14. The communication apparatus of claim 13, wherein the antenna is an inverted f antenna.

15. The communication apparatus of claim 13, wherein the third conductive element is parallel but not coplanar with the first conductive element.

16. The communication apparatus of claim 13, wherein the first conductive element includes a first portion that is orthogonal to the first conductive element and the second conductive element and parallel to the third conductive element.

17. The communication apparatus of claim 16, wherein the third conductive element and the first portion of the first conductive element support the antenna on a printed circuit board, the printed circuit board also used for the circuit.

18. The communication apparatus of claim 16, wherein the second conductive element includes a first section that extends from an upper edge of the second conductive element and is parallel to the printed circuit board when the antenna is mounted to the printed circuit board.

19. The communication apparatus of claim 16, wherein the antenna can be placed by machine without the antenna moving or tilting in any direction prior to attaching to the printed circuit board.

20. The communication apparatus of claim 16, wherein the third conductive element and the first conductive element rest on a surface of the printed circuit board.

21. The communication apparatus of claim 13, wherein the third conductive element is capacitively coupled to the ground of the circuit.

22. The communication apparatus of claim 13, wherein the fourth conductive element includes a first portion that is orthogonal to the first conductive element and the second conductive element and parallel to the third conductive element.

23. The communication apparatus of claim 13, wherein the fourth conductive element connects to an electrical element in the circuit and the first conductive element connects to the ground of the circuit.

24. The communication apparatus of claim 13, wherein the antenna is used at an electrical frequency that is less than or equal to 2.5gigahertz.

25. A method comprising:

forming a first conductive element of an antenna structure, the first conductive element having a first length, the first conductive element including a first connecting interface to connect, at a first end, the antenna structure to an electrical circuit;

forming a second conductive element of the antenna structure, the second conductive element having a second length and further connecting, at a first end, to a second end of the first conductive element;

forming a third conductive element of the antenna structure, the third conductive element having a third length and further connecting, at a first end, to a second end of the second conductive element and oriented at an angle that is orthogonal to the first conductive element and the second conductive element; and forming a fourth conductive element having the first length, the fourth conductive element connected, at a first end, to the second conductive element at a point on the second conductive element between the first conductive element and the third conductive element, the fourth conductive element connected, at a second end, to the electrical circuit, the fourth conductive element being in parallel and coplanar with the first conductive element.

26. The method of claim 25, wherein the third conductive element is parallel but not coplanar with the first conductive element.

27. The method of claim 25, wherein the first conductive element includes a first portion that is orthogonal to the first conductive element and the second conductive element and parallel to the third conductive element.

28. The method of claim 27, wherein the third conductive element and the first section of the first conductive element support the antenna structure on a printed circuit board.

29. The method of claim 28, wherein the second conductive element includes a first section that extends from an upper edge of the second conductive element and is parallel to the printed circuit board when the antenna structure is mounted to the printed circuit board.

30. The method of claim 29, wherein the antenna structure can be placed by machine without the antenna structure moving or tilting in any direction prior to attaching to the printed circuit board.

31. The method of claim 28, wherein the third conductive element and the first conductive element rest on a surface of the printed circuit board.

32. The method of claim 25, wherein the third conductive element is capacitively coupled to the ground of the electrical circuit.

33. The method of claim 25, further including forming a fourth conductive element of the antenna structure, the fourth conductive element having the first length and further connecting, at a first end, to the second conductive element at a point on the second conductive element between the first conductive element and the third conductive element, the fourth conductive element also connecting, at a second end, to the electrical circuit, the fourth conductive element being in parallel and coplanar with the first conductive element.

34. The method of claim 25, wherein the fourth conductive element includes a first portion that is at an angle orthogonal to the first conductive element and the second conductive element and parallel to the third conductive element.

35. The method of claim 25, wherein the fourth conductive element connects to an electrical element in the electrical circuit and the first conductive element connects to the ground of the electrical circuit.

36. The method of claim 25, wherein the method forms an inverted f antenna structure.

37. The method of claim 25, wherein the antenna structure is used at an electrical frequency that is less than or equal to 2.5gigahertz.

* * * * *